United States Patent [19]

Facco et al.

[11] 4,203,717

[45] May 20, 1980

[54] FLAT FLAME BURNER ASSEMBLY

[75] Inventors: Giuseppe Facco; Tomaso Carpaneto, both of Genoa, Italy

[73] Assignee: Italimpliant Societa Italiana Impianti per Asioni, Genoa, Italy

[21] Appl. No.: 867,226

[22] Filed: Jan. 6, 1978

[30] Foreign Application Priority Data

Jan. 14, 1977 [IT] Italy ..... 12418 A/77

[51] Int. Cl.[2] ..... F23M 9/00

[52] U.S. Cl. ..... 431/182; 431/189; 239/406; 239/404; 239/419.3

[58] Field of Search ..... 431/352, 348, 347, 182, 431/183, 189, 174; 239/400, 401, 402, 406, 419.3

[56] References Cited

U.S. PATENT DOCUMENTS

| | | | |
|---|---|---|---|
| 2,980,171 | 4/1961 | Fhrczyk et al. | 431/348 |
| 3,144,897 | 8/1964 | Biber et al. | 431/352 |
| 3,406,002 | 10/1968 | Martin | 239/406 |
| 3,610,537 | 10/1971 | Nishinomiya et al. | 239/419.3 |
| 3,671,172 | 6/1972 | Chadaille et al. | 431/182 |

*Primary Examiner*—Samuel Scott
*Assistant Examiner*—Wesley S. Ratliff, Jr.
*Attorney, Agent, or Firm*—Berman, Aisenberg & Platt

[57] ABSTRACT

A flat flame burner assembly comprises a refractory block having a flaring port and a hollow body, mounted thereon, provided with an inlet for the admission of combustion air and with an air diffuser presenting passages directed so as to cause the combustion air to swirl in the combustion zone of the flaring port; a burner mechanism comprising a lance for feeding the fuel terminating with a burner head extending in the combustion zone, a first pipe for a fluid atomizing agent coaxial to said lance, a second pipe, coaxial to the first pipe, for feeding air for the protection of the burner head from the heat, in communication with a sheath which surrounds the burner head. The burner head consists of a first chamber in which the fuel is admitted by means of a distributor, and of a second chamber, or mixing chamber, in which the fuel is atomized by the atomizing agent, and then sprayed into the combustion zone through a nozzle.

3 Claims, 7 Drawing Figures

9
A
1
2
180
180
3
108
7
8
F
104
4
104
11
10
6
106
5

9
308
1
2
7
3
8
208
F
111
111
104
104
4
11
10
106
6
-5-

FLAT FLAME BURNER ASSEMBLY

BACKGROUND OF THE INVENTION (1) Field of the Invention

The present invention relates to burners for furnaces, operating with liquid fuel (either light or heavy, volatile or non-volatile) and more particularly to those burners of the so-called flat flame type, in which the combustion is completed in the flame at a very short distance from the nozzle of the burner, and for instance at a distance in the order of 30 to 50 centimeters.

(2) Statement of the Prior Art Known.

The following prior art is know to the applicants:

British Pat. No. 854,301 (BLOOM) page 1, lines 11–54; page 2, lines 35–130; page 3, lines 1–87; FIGS. 2 and 4

U.S. Pat. No. 3,240,254 (HUGHES) column 2, lines 45–72; column 3, lines 1–23; column 5, lines 41–51; column 10, lines 44–62; FIGS. 1 to 14.

German publication of application No. 2,511,500 (SMIT NIJMEGEN) page 1, paragraph 1, page 4; page 5, paragraphs 1–3; page 13; FIGS. 1, 13A and 13B.

U.S. Pat. No. 3,979,069 (GAROFALO) the whole document.

U.S. Pat. No. 3,897,200 (CHILDREE) the whole document.

U.S. Pat. No. 2,969,833 (BLOOM) the whole document.

SUMMARY OF THE INVENTION

The invention relates to an improvement in the flat flame burners of the type referred to, in which the liquid fuel is atomized by an auxiliary fluid atomizing agent, and the combustion air is caused to swirl so that the flame generated inside the combustion zone of a flaring port formed in the wall or crown of a furnace is fully developed outside of that port at a short distance from the edges of same. According to the invention, there are provided means for imparting a high inflow velocity to the combustion air fed into the flame zone with a high rate of swirl of said air, and means for producing a jet of atomized liquid fuel having a very high rate of atomization and a very low rate of emission, thus obtaining, by this functional cooperation, the advantage consisting in the fact that the combustion air effectively drives and distributes the atomized fuel particles into the flame body, so that the optimum operation and efficiency of the burner is achieved.

Furthermore, in the improved burner according to the invention, the high component of swirl imparted to the combustion air generates a strong circulation of fumes in the middle area of the flaring port, and these fumes, coming at high temperature into contact with the atomized fuel, cause a vaporization of the fuel itself in the stage immediately preceding the proper combustion, which is thus facilitated.

These and other characteristic features of the invention and the advantages arising therefrom will appear more evident from the following detailed description of two preferred embodiments thereof, made with reference to the accompanying drawings.

DESCRIPTION OF THE PREFERRED EMBODIMENT

Figure 1:
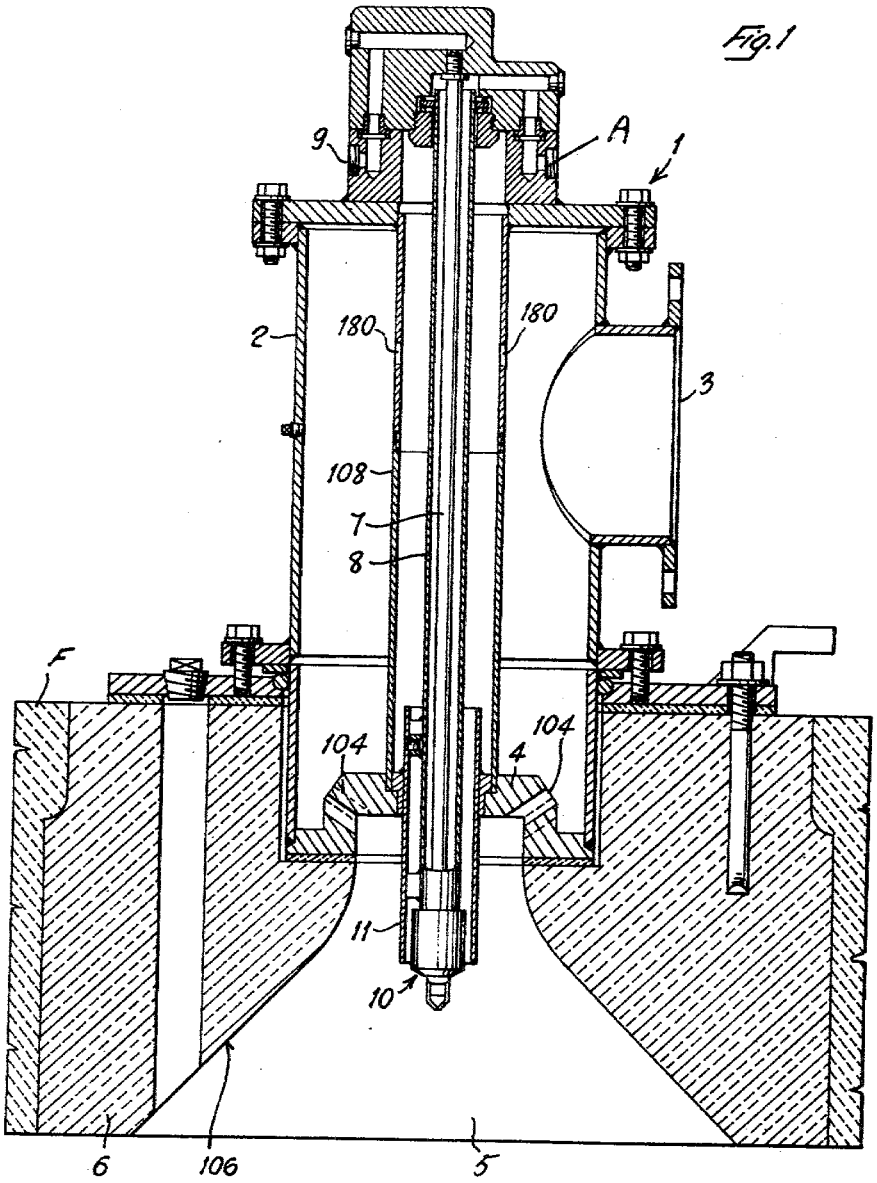
FIG. 1 is an elevational sectional view of a liquid fuel burner, particularly a siderurgical radiation furnace oil burner, according to the present invention.

Referring to the drawings, and first of all to the embodiment shown in FIGS. 1 to 4, the improved burner is shown in one embodiment which is particularly adapted for running with a heavy liquid fuel.

In this application, the burner comprises a tightly sealed hollow body 2 which is formed as a molding or is constructed as a metallic structural work. Into the hollow body 2 the combustion air is supplied through the inlet port 3. This air can be fed either cool or warm (pre-heated air). The body 2 is operatively fitted onto an associated diffuser 4 (either of metal or ceramic material) which has a set of suitable passageways 104 through which the combustion air is led into the combustion zone 5. The passageways 104 are set up in such a manner as to impart the air flowing therethrough a convenient and high rate of spin, or rate of swirl.

On the outside of furnace F, the hollow body 2 is mounted onto an associated ceramic block 6 having a suitably shaped cavity or port which flares out at the interior of the furnace. The said cavity provides the divergent tunnel or flaring port for achieving a short flame combustion, whereby the flame projects not too much from the edge of the flaring port and has for example a projection in the order of twenty centimeters.

Through the hollow body 2, into which the combustion air is admitted by the inlet port 3, there is vertically passed the lance 7 for delivering the liquid fuel (e.g. fuel oil) to the atomizing nozzle. This lance 7 is co-axially fitted in duct 8 for the delivery of the atomizing fluid to said nozzle. This fluid might be air under pressure, superheated steam, or another fluid under pressure, and is fed through union A. Co-axially to duct 8 there is mounted the outermost duct 108 forming an annular air space for circulation of the air for protecting the head 10 of the atomizing nozzle. Fuel oil is supplied from connection 9, and the protective air from bores 180.

The head 10 serves the purpose of atomizing the liquid fuel in sufficiently fine manner for a quick combustion and preventing any carbon layers from being deposited on the ceramic cup 106 of the reverberation body 6. A sheath 11 made of a heat-refractory metallic material, or of a ceramic material, is fitted around the lance 7 over its entire length which projects into chamber 5. In the interspace between this sheath and the entire lance itself, a certain flow of fluid is caused to stream in order to protect the lance and part of the head from the furnace radiation (reverberation) and from the radiation of the flame itself. From a functional viewpoint, this sheath is not indispensable and might be replaced, by suitable insulation to be applied all around on the lance, in correspondence of its portion projecting inside the ceramic cup 106.

Figure 2:
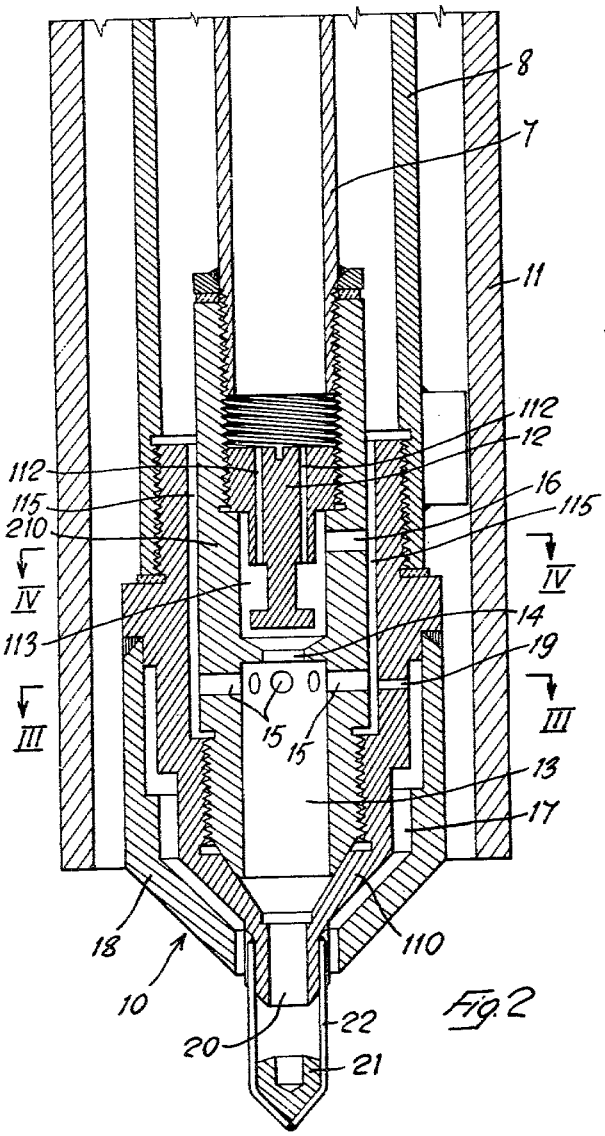
FIG. 2 is a vertical sectional view, which shows in greater detail the head for atomizing the fuel oil in the burner of FIG. 1.
Figure 4:
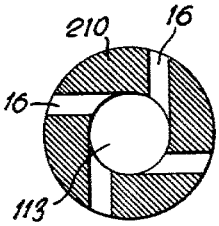
FIG. 4 is a section on line IV—IV of a detail of FIG. 2, which shows an arrangement of tangential bores which are adapted for inducing a high component of swirl in the stream of the atomizing fluid.
Figure 3:
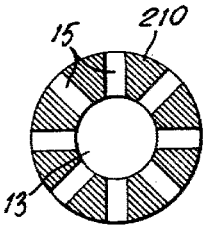
FIG. 3 is a section on line III—III of a detail of FIG. 2, which shows an arrangement of radial bores for the passage of the atomizing fluid into the burner head.

The burner head 10 is connected by screwing to the end section of the lance 7 and of pipe 8 for the atomizing fluid, in the manner as shown in the detail of FIG. 2. The outermost sheath 11 extends freely in the downward direction, to cover laterally most of head 10. This arrangement is in order to protect the liquid fuel from the high temperature of the flame in the lower section of lance 7.

In the uppermost central portion of head 10 there is fitted a fuel oil distributor 12 which is provided with suitably gauged bores 112 for feeding fuel oil into the mixing chamber 13.

As it appears in FIG. 2, the nozzle which is generally indicated by 10 and is referred to by the term "head", is composed of two sections 110, 210 firmly screwed together. At the lower end of the innermost section 210 there is formed the mixing chamber 13 which communicates with the delivery side of distributor 12 through an axial aperture 14.

A crown arrangement of bores 15, which are radially formed in the said section 210 of head 10 open into said chamber 13, and communicate with the delivery of the atomizing fluid in an interspace 115 between the sections 110 and 210 of nozzle 10. This interspace 115 communicates with the interspace between the co-axial ducts 7 and 8, into which the atomizing fluid is supplied from a suitable fluid source (not shown).

Still referring to FIG. 2, in the said section 210 of head 110 there is formed another set of bores 16 which put the above-mentioned interspace 115 into communication with the chamber 113 in which the head of distributor 12 is received. These bores 16 present a characteristic tangential arrangement, such as to impart to the mixing fluid a convenient vortical motion with a very high swirl. The said interspace 115 also communicates by means of bores 19 with the frontal space 17 which is delimited all around the periphery of head member 110 by the inserted sleeve 18.

The air fuel mixture formed in chamber 13 through the atomization of the liquid fuel by the compressed nebulization air projected through bores 15 flows out of the frontal bore 20 in nozzle 110, and this bore may be differently shaped lengthwise, and may, for example, have a convergent, or a convergent-cylindrical, or a convergent-divergent shape.

Opposite to the exhaust port of bore 20, and in an axially aligned and suitably spaced relation form said port, there is arranged a cup 21 which is located on top of a cage-like member 22 formed by small rods having one end fitted in or welded to the fore section 110 of head 10.

Figure 5:
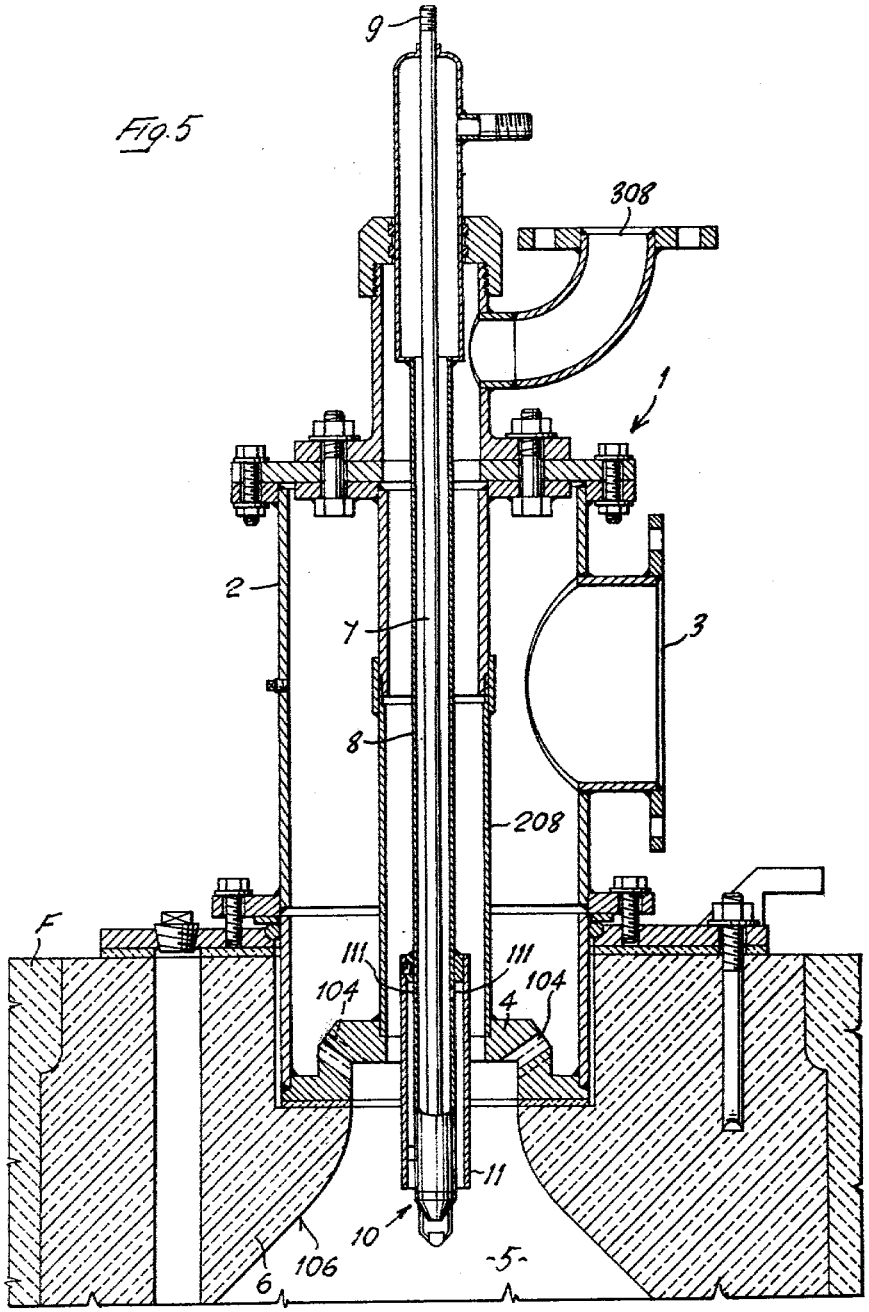
FIG. 5 is a vertical sectional view of a further embodiment, which shows a so-called mixed burner, i.e. a burner adapted for operation with a liquid heavy fuel and with a gaseous fuel.
Figure 7:
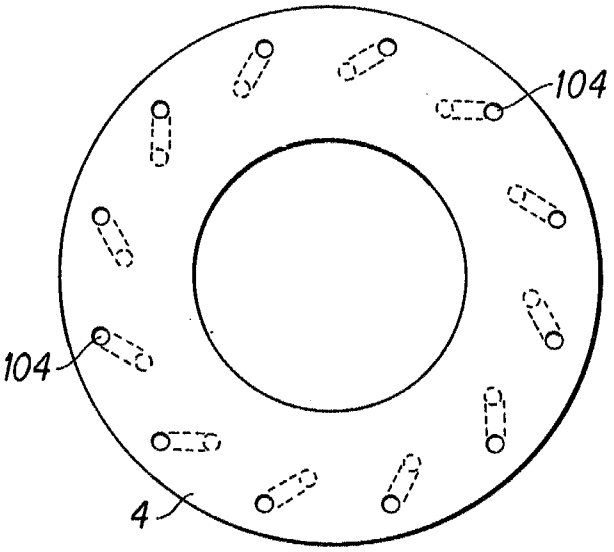
Figure 6:
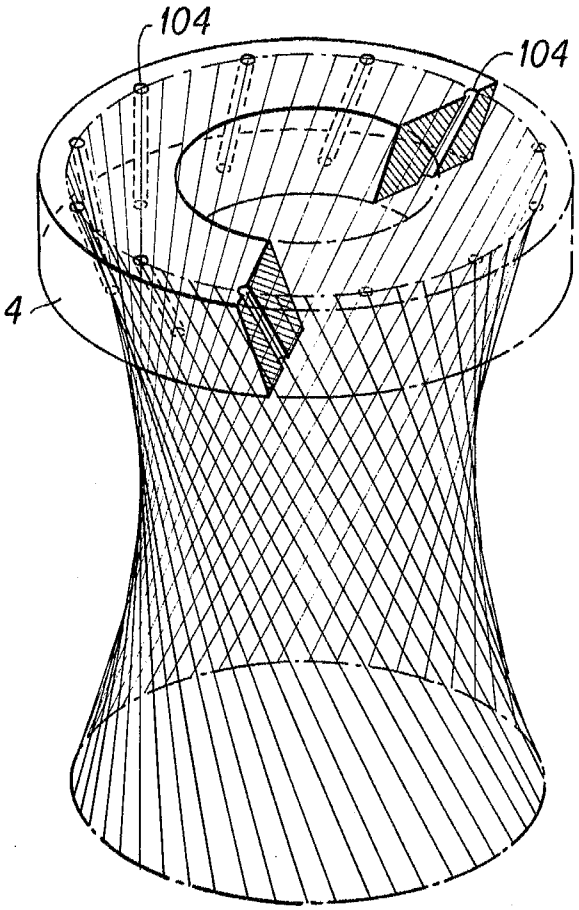

In case it should be required or convenient to have a multiple burner, i.e. a mixed-burner which is adapted for being operated simultaneously with a liquid and a gaseous fuel, the invention proposes the embodiment shown in FIG. 5, which is identical to the embodiment shown in FIG. 1 as for what concerns the members designated in FIGS. 1 and 5 by the same reference numerals, but differs from it in that the protective air duct is now substituted by the duct 208 for admission of the gaseous fuel from the intake opening 308.

In the case of an operation with gas only, the lance 7 is preferably arranged in a retracted position so that the nozzle 10 comes to be located within the outlet port of duct 208. In any case, the possible location of nozzle 10 in its projecting operative position as shown in FIG. 5 is not a drawback to the proper operation of the burner.

In the case of a burner operating with a mixed feed operation, in the interspace between the lance 7 and the pipe 8 located externally of, and co-axially to same, there circulates the atomizing fluid. In such a case, a small amount of said fluid may be diverted by tapping it off through pinholes 111 in the base of sleeve 11, so as to form a flow of protective fluid around the lance terminal section projecting into the burner combustion chamber.

Further details in construction are not described herein since they are not essential for the purposes of the present disclosure of the inventive concept.

In any case, however, the shape and the location of passages 104 in diffuser 4 should be such as to impart to the combustion air flowing therethrough the required velocity of swirl at the inlet in the area of flaring port 106, formed in the ceramic material block 6; particularly the invention provides that said passages be set in such a manner that their longitudinal geometrical axes come to be disposed according to the straight generatrices of a hyperboloid of rotation, co-axially to said flaring port, which might be similarly shaped. The combustion starts inside the flaring port and is completed outside of same, at a short distance from its edges. This distance is in relation with the excess air used, and is shorter as this excess is higher, coming down to 20–30 cm. for an excess air of 10% on the stoichiometric.

Owing to the high turbulence being generated at the inside of the flaring port or divergent tunnel, its inner walls 106 and the masonry portions directly close to its edges are thus convection-heated by the hot fumes and therefore heat by radiation the charge in the furnace.

Therefore, the improved burner according to the present invention renders possible a heat-exchange similar to that which is achievable with radiant burners operating with gas, with a resulting increase in the overall efficiency of the plant in which it is mounted as compared to the efficiency which is achievable with conventional long-flame burners.

Furthermore it is possible to have more furnace burners uniformly disposed, for example disposed along a furnace crown, so that the underlying charge in a furnace is uniformly heated.

The invention is not to be intended as limited to the embodiments which have been specifically shown and described by way of examples, since many changes, additions and/or modifications might be brought to same, without departing from the widest scope of the overall principles as above set forth and as claimed hereinafter.

We claim:

1. A flat flame burner assembly for use in furnaces, comprising:

(a) a refractory block having a flaring port which defines a central axis and a combustion zone;

(b) a hollow body mounted externally of the furnace on the said flaring port, provided with an inlet opening for the admission of combustion air and presenting an air diffuser member having passages directed in such a manner as to cause the combustion air to swirl around said central axis in the combustion zone of the flaring port;

(c) a burner mechanism comprising a lance for feeding the fuel terminating with a burner head extending into the combustion zone, said lance being coaxial to the said central axis of the port; a first pipe for a fluid atomizing agent under pressure, arranged externally and coaxially to said lance; a cylindrical sheath which surrounds the said burner head in the combustion chamber, said sheath being in communication with the said first pipe, whereby a portion of fluid atomizing agent is used to provide a fluid protection for the burner head from the heat, said lance carrying the burner head, said first pipe for the fluid atomizing agent and said protective sheath surrounding the burner head being movable in an axial direction towards and away from the combustion zone of the flaring port; a second pipe, mounted externally and coaxially to the said first pipe and terminating with an annular opening in correspondence of the diffuser member, for feeding a gaseous fuel into the combustion zone of the flaring port around the sheath surrounding the burner head, said burner head comprising:

a first chamber presenting a distributor for admitting the fuel and a first row of peripheral bores for admitting into said chamber the fluid atomizing agent, said bores being directed so as to confer a swirling motion to the said fluid atomizing agent;

a second chamber, or mixing chamber, in communication with the first chamber, provided with a second row of bores for admitting into said mixing chamber the fluid atomizing agent;

an outlet nozzle at the end of the mixing chamber, provided with an associated cup-like member held axially aligned opposite to said nozzle with its cavity directed towards the nozzle and at a predetermined distance therefrom.

2. A flat flame burner assembly for use in furnaces, comprising:

(a) a refractory block having a flaring port which defines a central axis and a combustion zone;

(b) a hollow body mounted externally of the furnace on the said flaring port, provided with an inlet opening for the admission of combustion air and presenting an air diffuser member having passages, the geometrical axes of which are arranged according to the straight generatrices of a hyperboloid, in such a manner as to cause the combustion air to swirl around said central axis in the combustion zone of the flaring port;

(c) a burner mechanism comprising a lance for feeding the fuel terminating with a furner head extending into the combustion zone, said lance being coaxial to the said central axis of the port, a first pipe for a fluid atomizing agent under pressure, arranged externally and coaxially to said lance, a second pipe, mounted externally and coaxially to the said first pipe, for providing air for protecting the burner head from the heat, said second pipe being in communication with a cylindrical sheath which surrounds the said burner head in the combustion zone, said burner head comprising:

a first chamber presenting a distributor for admitting the fuel and a first row of peripheral bores for admitting into said chamber the fluid atomizing agent, said bores being directed so as to confer a swirling motion to the said fluid atomizing agent;

a second chamber, or mixing chamber, in communication with the first chamber, provided with a second row of bores for admitting into said mixing chamber the fluid atomizing agent;

an outlet nozzle at the end of the mixing chamber, provided with an associated cup-like member held axially aligned opposite to said nozzle with its cavity directed towards the nozzle and at a predetermined distance therefrom.

3. A flat flame burner assembly for use in furnaces, comprising:

(a) a refractory block having a flaring port which defines a central axis and a combustion zone;

(b) a hollow body mounted externally of the furnace on the said flaring port, provided with an inlet opening for the admission of combustion air and presenting an air diffuser member having passages, the geometrical axes of which are arranged according to the straight generatrices of a hyperboloid, in such a manner as to cause the combustion air to swirl around said central axis in the combustion zone of the flaring port;

(c) a burner mechanism comprising a lance for feeding the fuel terminating with a burner head extending into the combustion zone, said lance being coaxial to the said central axis of the port, a first pipe for a fluid atomizing agent under pressure, arranged externally and coaxially to said lance, a cylindrical sheath which surrounds the said burner head in the combustion chamber, said sheath being in communication with the said first pipe, whereby a portion of fluid atomizing agent is used to provide a fluid protection for the burner head from the heat, a second pipe, mounted externally and coaxially to the said first pipe and terminating with an annular opening in correspondence of the diffuser member, for feeding a gaseous fuel into the combustion zone of the flaring port around the sheath surrounding the burner head, said burner head comprising:

a first chamber presenting a distributor for admitting the fuel and a first row of peripheral bores for admitting into said chamber the fluid atomizing agent, said bores being directed so as to confer a swirling motion to the said fluid atomizing agent;

a second chamber, or mixing chamber, in communication with the first chamber, provided with a second row of bores for admitting into said mixing chamber the fluid atomizing agent;

an outlet nozzle at the end of the mixing chamber, provided with an associated cup-like member held axially aligned opposite to said nozzle with its cavity directed towards the nozzle and at a predetermined distance therefrom.

* * * * *